US010870291B2

(12) United States Patent
Rasmussen et al.

(10) Patent No.: US 10,870,291 B2
(45) Date of Patent: Dec. 22, 2020

(54) PARTIALLY DRIED INKJET MEDIA CONDITIONER

(71) Applicant: Hewlett-Packard Development Company, L.P., Spring, TX (US)

(72) Inventors: Steve O Rasmussen, Vancouver, WA (US); Kevin Lo, Vancouver, WA (US); Richard Lee Brinkly, Vancouver, WA (US); Mark H MacKenzie, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/326,057

(22) PCT Filed: Sep. 2, 2016

(86) PCT No.: PCT/US2016/050199

§ 371 (c)(1),
(2) Date: Feb. 15, 2019

(87) PCT Pub. No.: WO2018/044324

PCT Pub. Date: Mar. 8, 2018

(65) Prior Publication Data

US 2019/0176491 A1 Jun. 13, 2019

(51) Int. Cl.
*B41J 11/00* (2006.01)

(52) U.S. Cl.
CPC ..... *B41J 11/002* (2013.01)

(58) Field of Classification Search
CPC ..... B41J 11/002
See application file for complete search history.

(56) References Cited

U.S. PATENT DOCUMENTS

| | | | | |
|---|---|---|---|---|
| 6,079,330 | A | 6/2000 | Aoki et al. | |
| 6,272,310 | B1 | 8/2001 | Blair et al. | |
| 7,072,610 | B2 * | 7/2006 | Nakane | G03G 15/2021 399/328 |
| 8,231,196 | B2 | 7/2012 | Lang | |
| 8,889,738 | B2 | 11/2014 | LeFevre et al. | |
| 2002/0027587 | A1 | 3/2002 | Sugaya et al. | |
| 2002/0130939 | A1 | 9/2002 | Jacob | |
| 2003/0137572 | A1 | 7/2003 | Miyamoto et al. | |
| 2004/0141041 | A1 * | 7/2004 | Tsutsumi | B41J 2/2056 347/102 |
| 2005/0220505 | A1 * | 10/2005 | Hashimoto | G03G 15/2021 399/322 |
| 2008/0219682 | A1 * | 9/2008 | Yamasaki | G03G 15/5054 399/16 |
| 2009/0315926 | A1 | 12/2009 | Yamanobe | |
| 2015/0234332 | A1 | 8/2015 | Gotoda | |

FOREIGN PATENT DOCUMENTS

KR 20080070162 A 7/2008

* cited by examiner

*Primary Examiner* — Yaovi M Ameh
(74) *Attorney, Agent, or Firm* — Brooks Cameron & Huebsch PLLP

(57) ABSTRACT

In one example, a partially dried inkjet media conditioner can include: a print engine that encases a print zone within a housing, and a media path to provide partially dried inkjet media from the print zone to a conditioner within the print engine, wherein the conditioner comprises a heated pressure roller.

14 Claims, 9 Drawing Sheets

PARTIALLY DRIED INKJET MEDIA CONDITIONER

BACKGROUND

Inkjet printers can deposit quantities of printing fluid onto a printable media (e.g., paper, plastic, etc.). In some examples, inkjet printers can create a curl and/or cockle in the printed media when the printing fluid droplets deposited by the inkjet printer are not completely dry. In some examples, a number of physical properties of the printable media can be changed when the printing fluid droplets deposited by the inkjet printer are not completely dry. For example, the stiffness of the printable media can be changed when the printing fluid droplets deposited by the inkjet printer are not completely dry. The curl, cockle, and/or other physical properties that change due to the printing fluid droplets can make finishing processes difficult.

DETAILED DESCRIPTION

Figure 1:
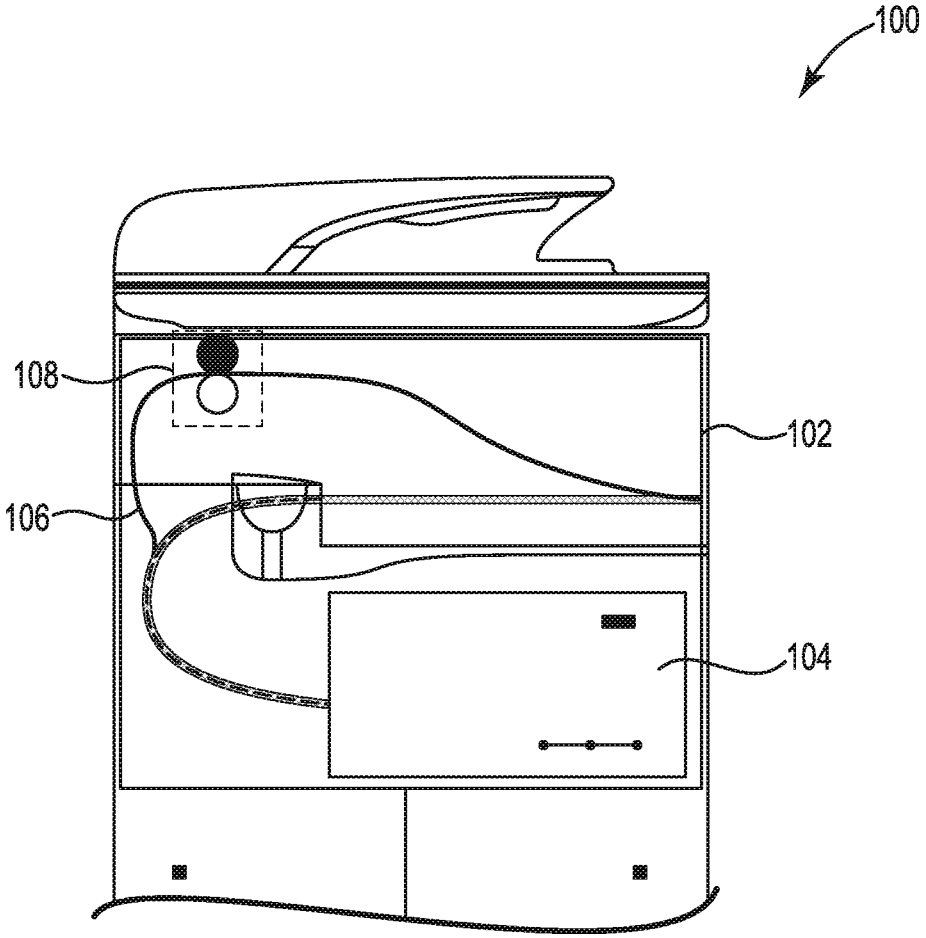
FIG. 1 illustrates an example system for a partially dried inkjet media conditioner consistent with the present disclosure.

A number of systems and devices for a partially dried inkjet media conditioner are described herein. In some examples, a partially dried inkjet media conditioner can include: a print engine that encases a print zone within a housing, and a media path to provide partially dried inkjet media from the print zone to a conditioner within the print engine, wherein the conditioner comprises a heated pressure roller. As used herein, partially dried inkjet media can include media with applied printing fluid from an inkjet type printing device that is not completely dried on the media.

The partially dried inkjet media can provide difficulties when stacking, aligning, and/or finishing. For example, the partially dried inkjet media can have distorted properties such as a curl, a cockle, a reduction in stiffness, increased surface roughness, extruding fibers from the surface, misaligned fibers, and/or increased sheet to sheet friction of the media. In some examples, these distorted properties can be caused by printing fluid deposited on the media and the media absorbing the printing fluid. For example, the printing fluid can be in a liquid state that can be absorbed by a media such as paper. In this example, the liquid state of the printing fluid can cause the distorted properties of the media in a similar way that other liquids may distort the properties of the media.

In some examples, the partially dried inkjet media conditioner can include a heated pressure roller within a print engine of the printing device. As used herein, a print engine encases (e.g., cover within an area, dispose within an area, fix within an area, etc.) a print zone within the printing device. In some examples, the print zone includes an area within the print engine to deposit printing fluid on a print media (e.g., paper, plastic, etc.). In some examples, the heated pressure roller can be utilized to increase evaporation of the printing fluid and/or increase drying of the partially dried inkjet media. In some examples, the increased evaporation of printing fluid can result in an increase of moisture, steam, and/or vapor within the print engine. In some examples, the partially dried inkjet media conditioner can be coupled to a vapor manager to remove moisture, steam, and/or vapor from an output of the partially dried inkjet media conditioner.

The figures herein follow a numbering convention in which the first digit corresponds to the drawing figure number and the remaining digits identify an element or component in the drawing. Elements shown in the various figures herein may be capable of being added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense.

FIG. 1 illustrates an example system 100 for a partially dried inkjet media conditioner consistent with the present disclosure. In some examples, the system 100 can include a print engine 102 that includes a print zone 104. In some examples, the print engine 102 can encase the print zone 104. As used herein, a print engine 102 includes a plurality of components for generating an image on print media within a housing. The housing of the print engine can physically encase the plurality of components (e.g., provide a physical barrier for the plurality of components within the print engine). In some examples, the plurality of components can include, but are not limited to: print heads, printing fluid supply, electronics, drivers, print zone, media pathways, image processing devices, and/or computing devices.

As used herein, the print zone 104 is an area that deposits a printing fluid on to a print media. In some examples, the print media can be directed out of the print zone 104 as partially dried inkjet media. In some examples, the partially dried inkjet media can be provided to a conditioner 108 by a media pathway 106. In some examples, the conditioner 108 can include a heated pressure roller. In some examples, the conditioner 108 can also include additional elements that promote conditioning of the partially dried inkjet media. For example, the conditioner 108 can include a vapor manager, input and output rollers to transition the partially dried inkjet media from a first direction to a second direction, and/or other elements to remove distorted properties of the partially dried inkjet media.

In some examples, the conditioner 108 can include a pressure roller to receive a first side of the partially dried inkjet media from the print zone 104. In some examples, the pressure roller can be positioned to receive a top side of the partially dried inkjet media as illustrated in FIG. 1. For examples, the pressure roller of the conditioner 108 can be positioned above a heated roller as illustrated in FIG. 1 to interact with a top side of the partially dried inkjet media. In some examples, the heated roller can be a belt roller as described herein.

In some examples, the conditioner 108 can include a heated roller to receive a second side of the partially dried inkjet media from the print zone 104. In some examples, the second side of the partially dried inkjet media can be an opposite side from the first side of the partially dried inkjet media. In some examples, the heated roller can be positioned below a pressure roller as described herein. In some examples, the heated roller can be utilized to apply heat to the second side of the partially dried inkjet media.

In some examples, the conditioner 108 can be encased within the print engine as described herein. In some examples, the conditioner 108 can increase evaporation of printing fluid applied to the partially dried inkjet media and/or increase drying of the partially dried inkjet media. In some examples, the conditioner 108 can generate moisture, steam, and/or vapor within the print engine 102 from the increased evaporation of the partially dried inkjet media. In some examples, the system 100 can include a vapor manager at an output of the conditioner 108 to remove the moisture, steam, and/or vapor from within the print engine 102.

As described herein, the partially dried inkjet media can provide difficulties when stacking, aligning, and/or finishing. By including a conditioner 108 within the print engine 102, the partially dried inkjet media can be dried at a relatively faster rate without increasing a foot print of the system 100. In addition, including the conditioner 108 within the print engine 102 can allow standard devices (e.g., paper handling accessories, etc.) to be coupled to an output of the system 100. For example, an output of the print engine 102 can be mated with a standard device without modification of the output and/or the standard device.

Figure 2:
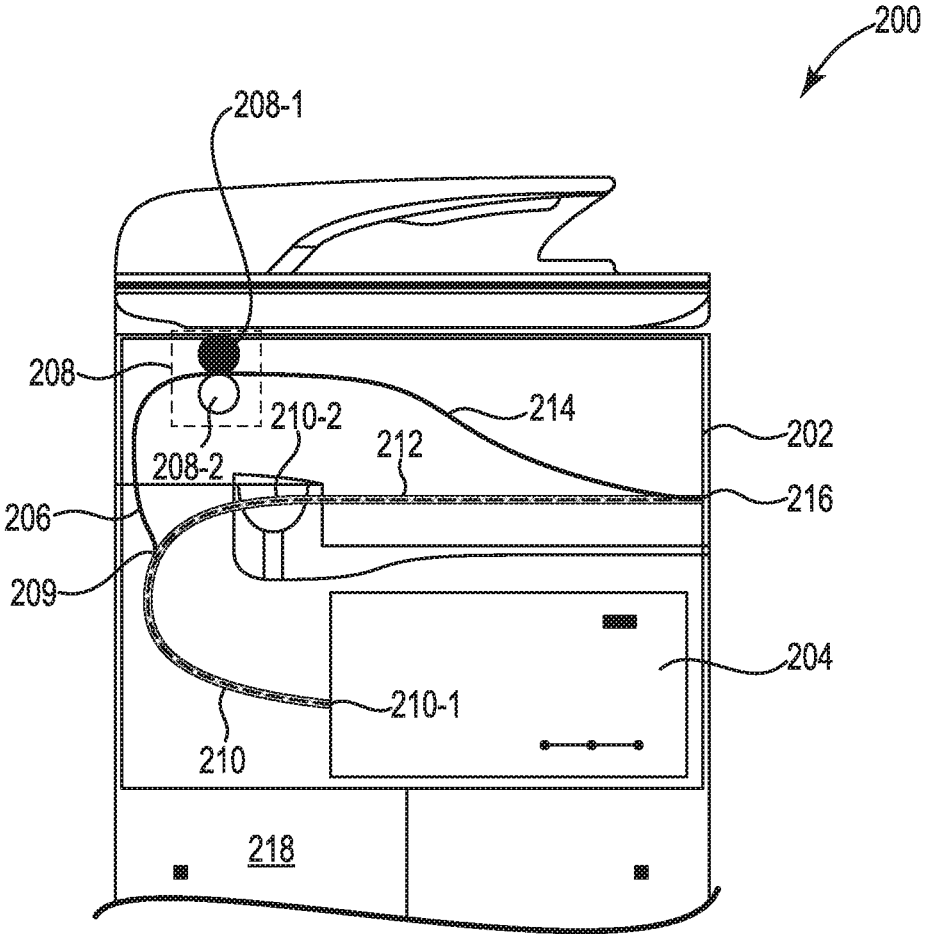
FIG. 2 illustrates an example system for a partially dried inkjet media conditioner consistent with the present disclosure.

FIG. 2 illustrates an example system 200 for a partially dried inkjet media conditioner consistent with the present disclosure. In some examples, the system 200 can include a number of features that are the same or similar as system 100 as referenced in FIG. 1. For example, the system 200 can include a print engine 202 that encases a print zone 204. In some examples, the system 200 can be an inkjet printing device with an inkjet print zone 204. As described herein, the print zone 204 can include a plurality of inkjets to deposit printing fluid on to print media.

In some examples, the print zone 204 can receive print media from a print media storage 218 (e.g., media tray, paper tray, etc.). In some examples, the print zone 204 can be coupled to the print media storage 218 by a media pathway. In some examples, the print zone 204 can be coupled to an input 210-1 of a dryer zone 210. In some examples, the dryer zone 210 can be a media pathway to allow the partially dried inkjet media from the print zone 204 to dry while the partially dried inkjet media is within the dryer zone 210. In some examples, the dryer zone 210 can include air circulation, heating devices, and/or other drying elements to increase drying of the partially dried inkjet media.

In some examples, the dryer zone 210 can be coupled to a media pathway 206 to direct the partially dried inkjet media to a conditioner 208. In some examples, the dryer zone 210 can be coupled to the media pathway 206 at position 209. In some examples, the position 209 can be between an input 210-1 of the dryer zone 210 and an output 210-2 of the dryer zone 210. That is, when the partially dried inkjet media is directed to the conditioner 208, the partially dried inkjet media may not pass through the output 210-2 of the dryer zone 210. For example, the partially dried inkjet media may pass through a first portion of the dryer zone 210 and bypass a second portion of the dryer zone 210. In some examples, the first portion of the dryer zone 210 can be approximately 70 percent of the total dryer zone 210 and the second portion of the dryer zone 210 can be approximately 30 percent of the total dryer zone 210.

In some examples, the system 200 can utilize a portion of the dryer zone 210. In some examples, a speed of the partially dried inkjet media can be reduced to increase a quantity of time the partially dried inkjet media is within the dryer zone 210. In some examples, the temperature of the dryer zone 210 can be increased to provide a similar drying effect as if the partially dried inkjet media passed through the entire dryer zone 210.

In some examples, the output 210-2 of the dryer zone 210 can be coupled to a duplexer zone 212. In some examples, the duplexer zone 212 can be utilized for duplexing relatively large print media (e.g., longer media such as Legal, A3, B size, etc.). In some examples, the duplexer zone 212 can be utilized to bypass the conditioner 208 until the relatively large print media has been returned to the print zone 204 to deposit printing fluid on a second side of the relatively large print media. For example, print media from the print media storage 218 can be provided to the print zone 204. In this example, the print zone 204 can deposit printing fluid to a first side of the print media. In this example, the print media can be partially dried inkjet media provided to the input 210-1 of the dryer zone 210. In this example, the partially dried inkjet media can be relatively large partially dried inkjet media that is provided to the duplexer zone 212 and returned to the print zone 204 to deposit printing fluid on a second side of the print media. In some examples, the relatively large partially dried inkjet media that is designated for single sided printing can be provided to the input 210-1 of the dryer zone 210 and provided to the conditioner 208 as described herein.

In some examples, the conditioner 208 can include a heated pressure roller. In some examples, the conditioner 208 can include a single direction heated pressure roller. In some examples, the conditioner 208 can include a single direction heated pressure roller to avoid conditioning a first portion of the partially dried inkjet media without conditioning a second portion, which can cause inconsistent sheet characteristics. For example, the conditioner 208 can receive the partially dried inkjet media at an input and provide the partially dried inkjet media to an acceleration zone 214. In this example, the conditioner 208 may not be able to reverse the direction of the partially dried inkjet media. For example, the conditioner 208 can receive partially dried inkjet media from the media pathway 206 and provide the partially dried inkjet media to the acceleration zone 214, but may not be able to reverse the direction of the partially dried inkjet media to provide the partially dried inkjet media from the acceleration zone 214 to the media pathway 206. This example can reduce cost of including a multi-directional heated pressure roller. This example can also prevent generated moisture, steam, and/or vapor generated by the heated pressure roller from exiting at the input of the conditioner 208. In some examples, the acceleration zone 214 can be utilized to provide the partially dried inkjet media to the output zone 216 at an accelerated rate to provide a greater quantity of time for paper handling accessories to process each sheet of partially dried inkjet media.

In some examples, the media pathway 206 can include a vertical portion (e.g., upward direction as illustrated in FIG. 2) that is coupled to the dryer zone 210 at position 209. In some examples, the vertical portion can bring the partially dried inkjet media from the dryer zone to a transition point 250. In some examples, the transition point 250 can direct the partially dried inkjet media from the vertical portion to a horizontal portion (e.g., directed from the left side of the print engine 202 to a right side of the print engine 202 as illustrated in FIG. 2). In some examples, the horizontal portion of the media pathway 206 can be coupled to the conditioner 208.

In some examples, the acceleration zone 214 can be utilized to increase a rate of the partially dried inkjet media for providing the partially dried inkjet media to an output zone 216. In some examples, the acceleration zone 214 can include a plurality of rollers to accelerate the rate or speed of the partially dried inkjet media. In some examples, the output zone 216 can be positioned above the print zone 204 on a right side of the print engine 202 as illustrated in FIG. 2. In some examples, the output zone 216 can be positioned on an opposite side of the print engine 202 than the conditioner 208. In some examples, positioning the conditioner 208 on a first side of the print engine 202 and positioning the output zone 216 on a second side of the print engine 202 can increase a distance of the acceleration zone 214.

In some examples, the conditioner 208 can include a heated pressure roller. In some examples, the heated pressure roller can be encased within the print engine 202 as described herein. In some examples, the heated pressure roller can include a pressure roller 208-1 to receive a first side of the partially dried inkjet media from the media pathway 206. In some examples, the pressure roller 208-1 can apply pressure to the first side of the partially dried inkjet media. In some examples, the increased pressure can increase evaporation of the printing fluid applied to the partially dried inkjet media. The increased evaporation of the printing fluid can increase drying of the partially dried inkjet media, which can restore a number of distorted properties of the partially dried inkjet media.

In some examples, the increased evaporation of the printing fluid can increase moisture, steam, and/or vapor at an output of the conditioner 208 or within the acceleration zone 214. In some examples, the increased moisture, steam, and/or vapor can result in condensation within the print engine 202 and can damage the partially dried inkjet media and/or components within the print engine 202. In some examples, a vapor manager can be coupled to an output of the conditioner 208. For example, a vapor manager can be coupled between the conditioner 208 and the acceleration zone 214. In some examples, the vapor manager can include an exhaust fan to remove moisture, steam, and/or vapor from the output of the conditioner 208.

In some examples, the conditioner 208 can include a heated pressure roller that is aligned in a vertical orientation. As used herein, a heated pressure roller in a vertical orientation includes a pressure roller 208-1 that is positioned above a heated roller 208-2. In some examples, the vertical orientation includes a center of a pressure roller 208-1 aligned vertically above a center of a heated roller 208-2.

In some examples, the conditioner 208 can be a removable conditioner. For example, the conditioner 208 can be removed from the print engine 202. In some examples, the conditioner 208 can include an enclosure that can be removed from an opening on a left side of the print engine 202 as illustrated in FIG. 2. In some examples, the conditioner 208 can be removed through an opening on a front side of the print engine 202 as illustrated in FIG. 2. For example, the conditioner 208 can be pulled out of the front of the print engine 202.

In some examples, the conditioner 208 can be positioned on an upper left portion of the print engine 202 as illustrated in FIG. 2. In these examples, the conditioner 208 can be positioned above dryer zone 210. In some examples, the conditioner 208 can be positioned directly above the dryer zone 210. In some examples, the conditioner 208 can be positioned in a first corner of the print engine 202 and the print zone 204 can be positioned in a second corner of the print engine 202. In some examples, positioning the conditioner 208 above the print zone 204 and above the dryer zone 210 can allow the moisture, steam, and/or vapor to be removed out of the side and/or top of the print engine 202.

As described herein, the partially dried inkjet media can provide difficulties when stacking, aligning, and/or finishing. By including a conditioner 208 within the print engine 202, the partially dried inkjet media can be dried at a relatively faster rate without increasing a foot print of the system 200. In addition, including the conditioner 208 within the print engine 202 can allow standard devices (e.g., paper handling accessories, etc.) to be coupled to an output 216 of the system 200.

Figure 3:
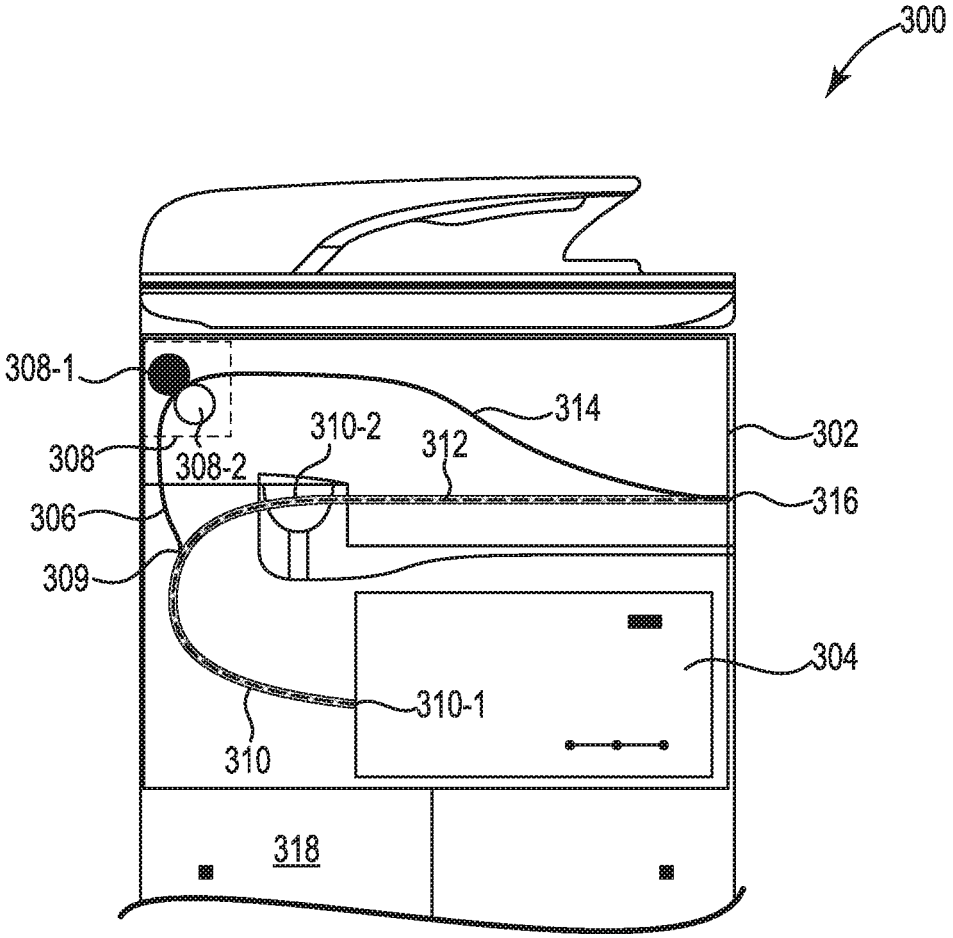
FIG. 3 illustrates an example system for a partially dried inkjet media conditioner consistent with the present disclosure.

FIG. 3 illustrates an example system for a partially dried inkjet media conditioner consistent with the present disclosure. In some examples, the system 300 can include a number of features that are the same or similar as system 100 as referenced in FIG. 1 and/or system 200 as referenced in FIG. 2. For example, the system 300 can include a print engine 302 that encases a print zone 304. In some examples, the system 300 can be an inkjet printing device with an inkjet print zone 304. As described herein, the print zone 304 can include a plurality of inkjets to deposit printing fluid on print media.

In some examples, the print zone 304 can receive print media from a print media storage 318. In some examples, the print zone 304 can be coupled to the print media storage 318 by a media pathway. In some examples, the print zone 304 can be coupled to an input 310-1 of a dryer zone 310. In some examples, the dryer zone 310 can be a media pathway to allow the partially dried inkjet media from the print zone 304 to dry while the partially dried inkjet media is within the dryer zone 310. In some examples, the dryer zone 310 can include air circulation, heat sources, and/or other drying elements to increase drying of the partially dried inkjet media.

In some examples, the dryer zone 310 can be coupled to a media pathway 306 to direct the partially dried inkjet media to a conditioner 308. In some examples, the dryer zone 310 can be coupled to the media pathway 306 at position 309. In some examples, the position 309 can be between an input 310-1 of the dryer zone 310 and an output 310-2 of the dryer zone 310. That is, when the partially dried inkjet media is directed to the conditioner 308, the partially dried inkjet media may not pass through the output 310-2 of the dryer zone 310. For example, the partially dried inkjet media may pass through a first portion of the dryer zone 310 and bypass a second portion of the dryer zone 310.

In some examples, the system 300 can utilize a portion of the dryer zone 310. In some examples, a speed of the partially dried inkjet media can be reduced to increase a quantity of time the partially dried inkjet media is within the portion of the dryer zone 310. In some examples, the temperature of the dryer zone 310 can be increased to provide a similar drying effect as if the partially dried inkjet media passed through the entire dryer zone 310.

In some examples, the output 310-2 of the dryer zone 310 can be coupled to a duplexer zone 312. In some examples, the duplexer zone 312 can be utilized for duplexing relatively large print media (e.g., longer media such as Legal, A3, B size, etc.). In some examples, the duplexer zone 312 can be utilized to bypass the conditioner 308 until the relatively large print media has been returned to the print zone 304 to deposit printing fluid on a second side of the relatively large print media.

In some examples, the conditioner 308 can include a heated pressure roller. In some examples, the conditioner 308 can be a single direction heated pressure roller. For example, the conditioner 308 can receive the partially dried inkjet media at an input and provide the partially dried inkjet media to an acceleration zone 314. In this example, the conditioner 308 may not be able to reverse the direction of the partially dried inkjet media. For example, the conditioner 308 can receive partially dried inkjet media from the media pathway 306 and provide the partially dried inkjet media to the acceleration zone 314, but may not be able to reverse the direction of the partially dried inkjet media to provide the partially dried inkjet media from the acceleration zone 314 to the media pathway 306. This example can reduce cost of including a multi-directional heated pressure roller. This example can also prevent generated moisture, steam, and/or vapor generated by the heated pressure roller from exiting at the input of the conditioner 308. In some examples, the acceleration zone 314 can be utilized to provide the partially dried inkjet media to the output zone 316 at an accelerated rate to provide a greater quantity of time for paper handling accessories to process each sheet of partially dried inkjet media.

In some examples, the media pathway 306 can include a vertical portion (e.g., upward direction as illustrated in FIG. 3) that is coupled to the dryer zone 310 at position 309. In some examples, the vertical portion can bring the partially dried inkjet media from the dryer zone to the conditioner 308. In some examples, a transition point may not be utilized with a conditioner 308 when the conditioner 308 is in an angled orientation as described further herein.

In some examples, the conditioner 308 can include a heated pressure roller. In some examples, the heated pressure roller can be encased within the print engine 302 as described herein. In some examples, the heated pressure roller can include a pressure roller 308-1 to receive a first side of the partially dried inkjet media from the media pathway 306. In some examples, the pressure roller 308-1 can apply pressure to the first side of the partially dried inkjet media. In some examples, the heated pressure roller can include a heated roller 308-2 to apply heat to a second side of the partially dried inkjet media. In some examples, the increased pressure and heat can increase evaporation of the printing fluid applied to the partially dried inkjet media. The increased evaporation of the printing fluid can increase drying of the partially dried inkjet media, which can restore a number of distorted properties of the partially dried inkjet media.

In some examples, the conditioner 308 can include a heated pressure roller that is aligned in an angled orientation. As used herein, a heated pressure roller in an angled orientation includes a pressure roller 308-1 that is positioned at an angle above a heated roller 308-2. In some examples, the angled orientation includes a center of a pressure roller 208-1 aligned to the left and above a center of a heated roller 308-2 as illustrated in FIG. 3. In some examples, the angled orientation can be utilized without a horizontal portion of the media pathway 308. For example, the media pathway 308 can be substantially vertical from the dryer zone 310 to the conditioner 308.

In some examples, the increased evaporation of the printing fluid can increase moisture, steam, and/or vapor at an output of the conditioner 308 or within the acceleration zone 314. In some examples, the increased moisture, steam, and/or vapor can result in condensation within the print engine 302 and can damage the partially dried inkjet media and/or components within the print engine 302. In some examples, a vapor manager can be coupled to an output of the conditioner 308. For example, a vapor manager can be coupled between the conditioner 308 and the acceleration zone 314. In some examples, the vapor manager can include an exhaust fan to remove moisture, steam, and/or vapor from the output of the conditioner 308.

In some examples, the conditioner 308 can be a removable conditioner. For example, the conditioner 308 can be removed from the print engine 302. In some examples, the conditioner 308 can include an enclosure that can be removed from an opening on a left side of the print engine 302 as illustrated in FIG. 3. In some examples, the conditioner 308 can be removed through an opening on a front side of the print engine 302 as illustrated in FIG. 3. For example, the conditioner 308 can be pulled out of the front of the print engine 302.

In some examples, the conditioner 308 can be positioned on an upper left portion of the print engine 302 as illustrated in FIG. 3. In some examples, the angled orientation of the conditioner 308 can allow the conditioner 308 to be positioned closer to the left side of the print engine 302 as illustrated in FIG. 3 compared to a vertical orientation. In some examples, the angled orientation can provide a relatively shorter travel distance for removal of the conditioner 308. In these examples, the conditioner 308 can be positioned above dryer zone 310. In some examples, the conditioner 308 can be positioned directly above the dryer zone 310. In some examples, the conditioner 308 can be positioned in a first corner of the print engine 302 and the print zone 304 can be positioned in a second corner of the print engine 302. In some examples, positioning the conditioner 308 above the print zone 304 and above the dryer zone 310 can allow the moisture, steam, and/or vapor to be removed out of the side or top of the print engine 302.

As described herein, the partially dried inkjet media can provide difficulties when stacking, aligning, and/or finishing. By including a conditioner 308 within the print engine 302, the partially dried inkjet media can be dried at a relatively faster rate without increasing a foot print of the system 300. In addition, including the conditioner 308 within the print engine 302 can allow standard devices (e.g., paper handling accessories, etc.) to be coupled to an output 316 of the system 300.

Figure 4:
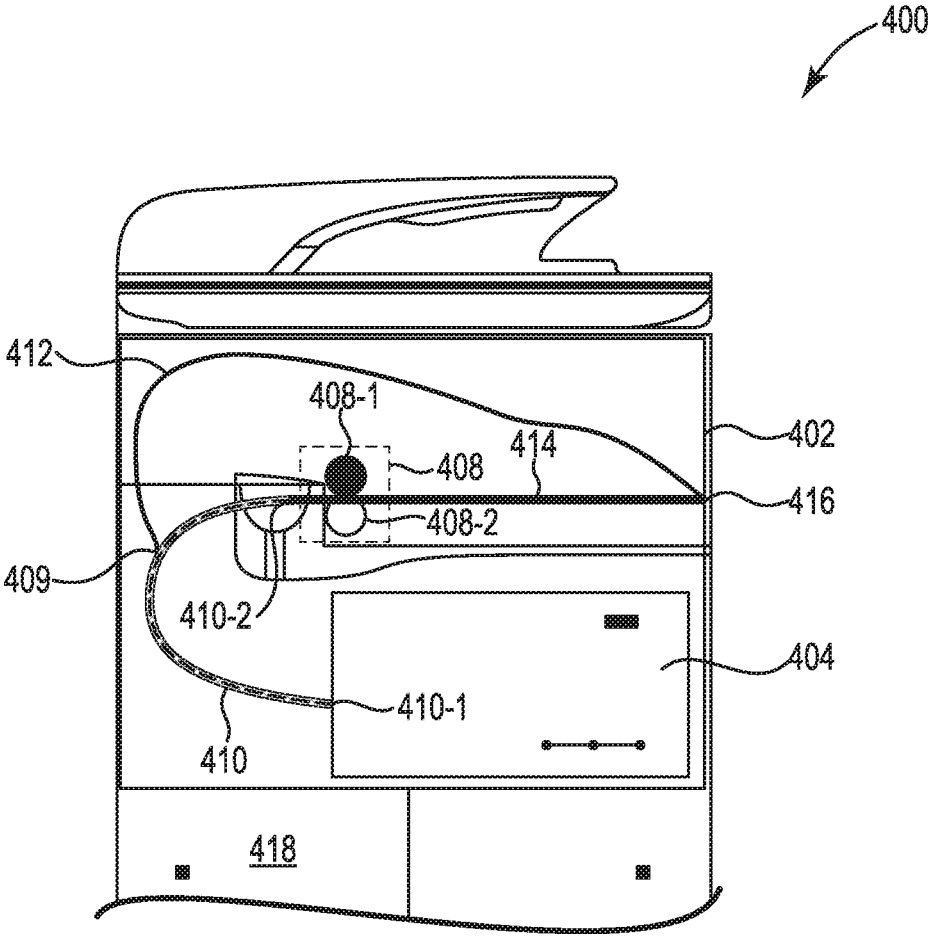
FIG. 4 illustrates an example system for a partially dried inkjet media conditioner consistent with the present disclosure.

FIG. 4 illustrates an example system 400 for a partially dried inkjet media conditioner consistent with the present disclosure. In some examples, the system 400 can include a number of features that are the same or similar as system 100 as referenced in FIG. 1, system 200 as referenced in FIG. 2, and/or system 300 as referenced in FIG. 3. For example, the system 400 can include a print engine 402 that encases a print zone 404, a dryer zone 410 with an input 410-1 coupled to the print zone 404 and an output 410-2 coupled to a conditioner 408.

As described herein, the conditioner 408 can include a heated pressure roller that includes a pressure roller 408-1 to receive a first side of partially dried inkjet media and a heated roller 408-2 to receive a second side of partially dried inkjet media. In some examples, the heated pressure roller of the conditioner 408 can be coupled to an output 410-2 of the dryer zone 410. In these examples, the partially dried inkjet media is able to pass through the entire dryer zone 410 when provided to the conditioner 408.

In some examples, the system 400 can include a duplexer zone 412. In some examples, the duplexer zone 412 can be utilized for duplexing relatively large print media (e.g., longer media such as Legal, A3, B size, etc.). In some examples, the duplexer zone 412 can be utilized to bypass the conditioner 408 until the relatively large print media has been returned to the print zone 404 to deposit printing fluid on a second side of the relatively large print media. In some examples, the duplexer zone 412 can be positioned above the dryer zone 410 and/or the conditioner 408. In some examples, the duplexer zone 412 can be coupled to a position 409 of the dryer zone 410. In some examples, the position 409 of the dryer zone 410 can be between an input 410-1 and an output 410-2 of the dryer zone 410.

In some examples, the conditioner 408 can be positioned in line with an output 416 of the print engine 402. For example, the output of the conditioner 408 can be coupled to an acceleration zone 414 that can provide the partially dried inkjet media to the output 416 of the print engine 402 substantially horizontal. The acceleration zone 414 can increase the speed of the partially dried inkjet media by positioning the conditioner in line with the output 416 of the print engine 402.

In some examples, the conditioner 408 can include a heated pressure roller that is aligned in a vertical orientation. As used herein, a heated pressure roller in a vertical orientation includes a pressure roller 408-1 that is positioned above a heated roller 408-2. In some examples, the vertical orientation includes a center of a pressure roller 408-1 aligned vertically above a center of a heated roller 408-2. In some examples, the conditioner 408 can be removed through an opening on a front side of the print engine 402 as illustrated in FIG. 4. For example, the conditioner 408 can be pulled out of the front of the print engine 402.

In some examples, the conditioner 408 can increase evaporation of printing fluid deposited on the partially dried inkjet media. In some examples, the increased evaporation of the printing fluid can increase moisture, steam, and/or vapor at an output of the conditioner 408 or within the acceleration zone 414. In some examples, the increased moisture, steam, and/or vapor can result in condensation within the print engine 402 and can damage the partially dried inkjet media and/or components within the print engine 402. In some examples, a vapor manager can be coupled to an output of the conditioner 408. For example, a vapor manager can be coupled between the conditioner 408 and the acceleration zone 414. In some examples, the vapor manager can include an exhaust fan to remove moisture, steam, and/or vapor from the output of the conditioner 408.

As described herein, the partially dried inkjet media can provide difficulties when stacking, aligning, and/or finishing. By including a conditioner 408 within the print engine 402, the partially dried inkjet media can be dried at a relatively faster rate without increasing a foot print of the system 400. In addition, including the conditioner 408 within the print engine 402 can allow standard devices (e.g., paper handling accessories, etc.) to be coupled to an output 416 of the system 400.

Figure 5:
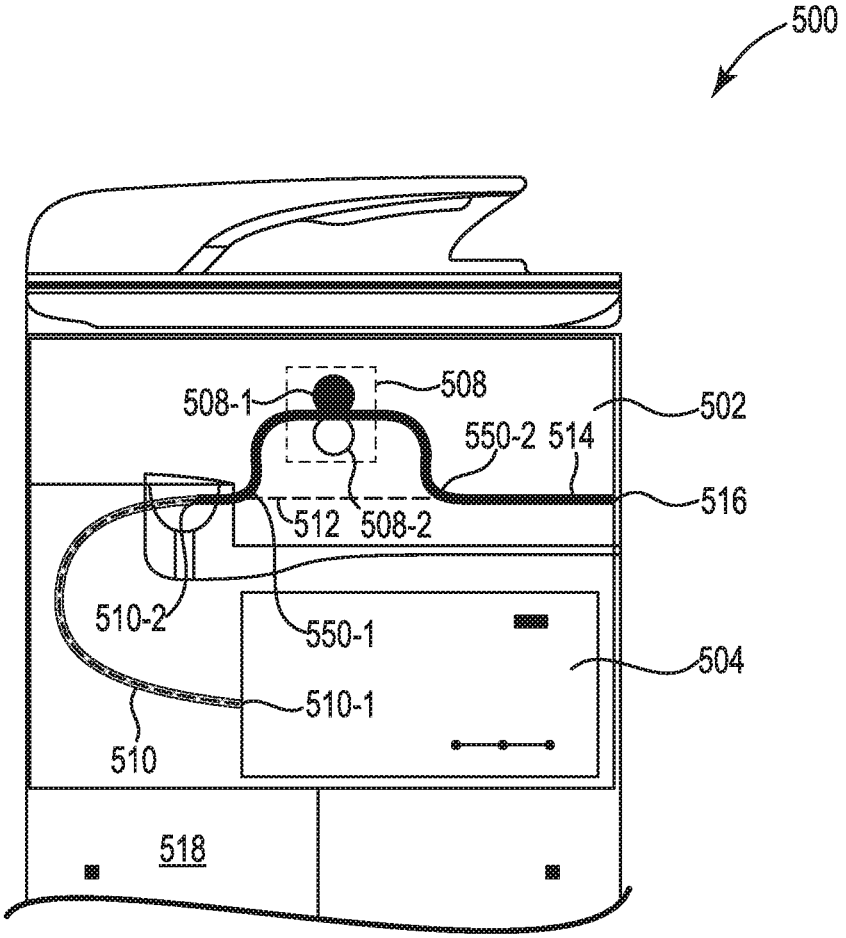
FIG. 5 illustrates an example system for a partially dried inkjet media conditioner consistent with the present disclosure.

FIG. 5 illustrates an example system 500 for a partially dried inkjet media conditioner consistent with the present disclosure. In some examples, the system 500 can include a number of features that are the same or similar as system 100 as referenced in FIG. 1, system 200 as referenced in FIG. 2, system 300 as referenced in FIG. 3, and/or system 400 as referenced in FIG. 4. For example, the system 500 can include a print engine 502 that encases a print zone 504, a dryer zone 510 with an input 510-1 coupled to the print zone 504 and an output 510-2 coupled to a conditioner 508.

As described herein, the conditioner 508 can include a heated pressure roller that includes a pressure roller 508-1 to receive a first side of partially dried inkjet media and a heated roller 508-2 to receive a second side of partially dried inkjet media. In some examples, the heated pressure roller of the conditioner 508 can be coupled to an output 510-2 of the dryer zone 510 by a media path 550-1. In these examples, the partially dried inkjet media is able to pass through the entire dryer zone 510.

In some examples, the media path 550-1 can direct the partially dried inkjet media in an upward vertical direction and in a horizontal direction prior to providing the partially dried inkjet media to the conditioner 508. In these examples, the output 510-2 of the dryer zone 510 can be in line with an output 516 of the print engine 502. In these examples, the conditioner 508 can be positioned above the output 510-2 of the dryer zone 510 and/or an output 516 of the print engine 502. In some examples, the output of the conditioner 508 can be coupled to an acceleration zone 514 by a media path 550-2. In some examples, the media path 550-2 can vertically lower the partially dried inkjet media from the output of the conditioner 508 to an input of the acceleration zone 514.

In some examples, the system 500 can include a duplexer zone 512. In some examples, the duplexer zone 512 can be utilized for duplexing relatively large print media (e.g., longer media such as Legal, A3, B size, etc.). In some examples, the duplexer zone 512 can be utilized to bypass the conditioner 508 until the relatively large print media has been returned to the print zone 504 to deposit printing fluid on a second side of the relatively large print media. In some examples, the duplexer zone 512 can be positioned inline with the dryer zone 510 and/or below the conditioner 508. In some examples, the duplexer zone 512 can be coupled to an output 510-2 of the dryer zone 510.

In some examples, the conditioner 508 can be positioned above the print zone 504 and the duplexer zone 512. In some examples, the conditioner 508 can include a heated pressure roller that is aligned in a vertical orientation. As used herein, a heated pressure roller in a vertical orientation includes a pressure roller 508-1 that is positioned above a heated roller 508-2. In some examples, the vertical orientation includes a center of a pressure roller 508-1 aligned vertically above a center of a heated roller 508-2. In some examples, the conditioner 508 can be removed through an opening on a front side of the print engine 502 as illustrated in FIG. 5. For example, the conditioner 508 can be pulled out of the front of the print engine 502.

In some examples, the conditioner 508 can increase evaporation of printing fluid deposited on the partially dried inkjet media. In some examples, the increased evaporation of the printing fluid can increase moisture, steam, and/or vapor at an output of the conditioner 508 or within the acceleration zone 514. In some examples, the increased moisture, steam, and/or vapor can result in condensation within the print engine 502 and can damage the partially dried inkjet media and/or components within the print engine 502. In some examples, a vapor manager can be coupled to an output of the conditioner 508. For example, a vapor manager can be coupled between the conditioner 508 and the acceleration zone 514. In some examples, the vapor manager can include an exhaust fan to remove moisture, steam, and/or vapor from the output of the conditioner 508.

As described herein, the partially dried inkjet media can provide difficulties when stacking, aligning, and/or finishing. By including a conditioner 508 within the print engine 502, the partially dried inkjet media can be dried at a relatively faster rate without increasing a foot print of the system 500. In addition, including the conditioner 508 within the print engine 502 can allow standard devices (e.g., paper handling accessories, etc.) to be coupled to an output 516 of the system 500.

Figure 6:
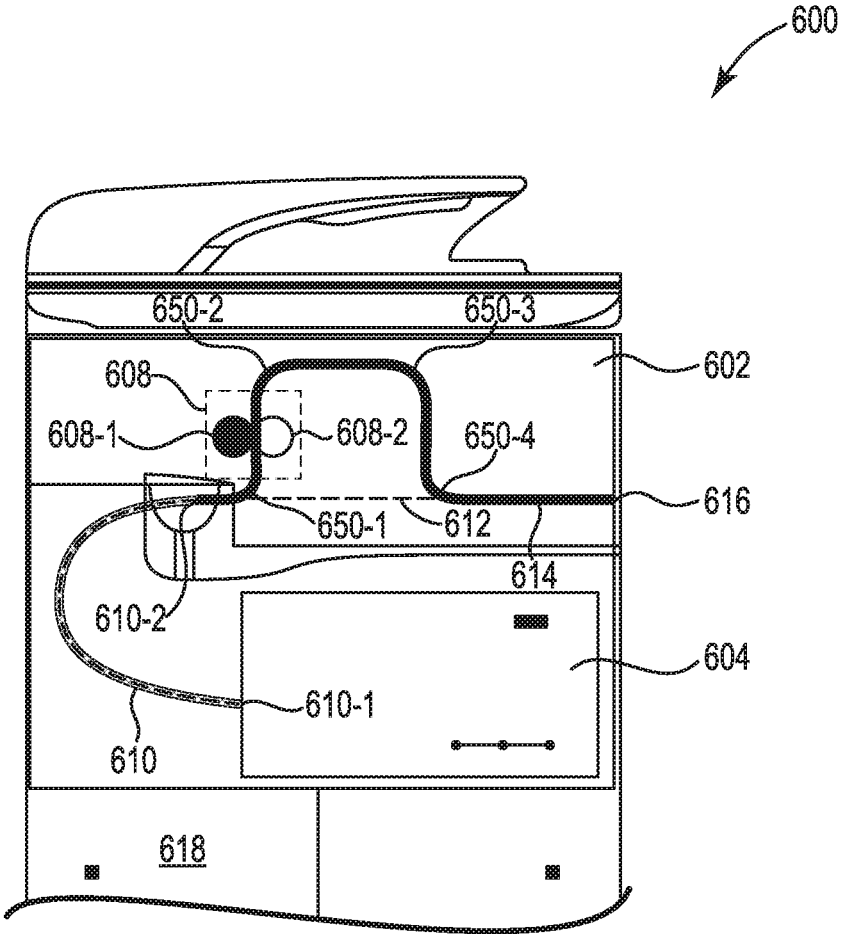
FIG. 6 illustrates an example system for a partially dried inkjet media conditioner consistent with the present disclosure.

FIG. 6 illustrates an example system for a partially dried inkjet media conditioner consistent with the present disclosure. In some examples, the system 600 can include a number of features that are the same or similar as system 100 as referenced in FIG. 1, system 200 as referenced in FIG. 2, system 300 as referenced in FIG. 3, system 400 as referenced in FIG. 4, and/or system 500 as referenced in FIG. 5. For example, the system 600 can include a print engine 602 that encases a print zone 604, a dryer zone 610 with an input 610-1 coupled to the print zone 604 and an output 610-2 coupled to a conditioner 608.

As described herein, the conditioner 608 can include a heated pressure roller that includes a pressure roller 608-1 to receive a first side of partially dried inkjet media and a heated roller 608-2 to receive a second side of partially dried inkjet media. In some examples, the heated pressure roller of the conditioner 608 can be utilized to increase evaporation of printing fluid applied to the partially dried inkjet media from the print zone 604. In some examples, the heated pressure roller of the conditioner 608 can be coupled to an output 610-2 of the dryer zone 610 by a media path 650-1. In these examples, the partially dried inkjet media is able to pass through the entire dryer zone 610.

In some examples, the media path 650-1 can direct the partially dried inkjet media in an upward vertical direction to provide the partially dried inkjet media to the conditioner 608. In these examples, the output 610-2 of the dryer zone 610 can be in line with an output 616 of the print engine 602. In these examples, the conditioner 608 can be positioned above the output 610-2 of the dryer zone 610 and/or an output 616 of the print engine 602. In some examples, the output of the conditioner 608 can be coupled to an acceleration zone 614 by media paths 650-2, 650-3, 650-4. In some examples, the media path 650-2 can horizontally move the partially dried inkjet media from the output of the conditioner 608 to media path 650-3. In some examples, the media path 650-3 can vertically lower the partially dried inkjet media to media path 650-4. In some examples, the media path 650-4 can horizontally direct the partially dried inkjet media to an input of the acceleration zone 614.

In some examples, the system 600 can include a duplexer zone 612. In some examples, the duplexer zone 612 can be utilized for duplexing relatively large print media (e.g., longer media such as Legal, A3, B size, etc.). In some examples, the duplexer zone 612 can be utilized to bypass the conditioner 608 until the relatively large print media has been returned to the print zone 604 to deposit printing fluid on a second side of the relatively large print media. In some examples, the duplexer zone 612 can be positioned inline with the dryer zone 610 and/or below the conditioner 608. In some examples, the duplexer zone 612 can be coupled to an output 610-2 of the dryer zone 610.

In some examples, the conditioner 608 can be positioned above the print zone 604 and the duplexer zone 612. In some examples, the conditioner 608 can include a heated pressure roller that is aligned in a horizontal orientation. As used herein, a heated pressure roller in a horizontal orientation includes a pressure roller 608-1 that is positioned on a first side (e.g., left side as illustrated in FIG. 6) and a heated roller 608-2 positioned on a second side (e.g., right side as illustrated in FIG. 6). In some examples, the horizontal orientation includes a center of a pressure roller 608-1 aligned horizontal side by side with a center of a heated roller 608-2. In some examples, the conditioner 608 can include an enclosure that can be removed from an opening on a left side of the print engine 602 as illustrated in FIG. 6. In some examples, the conditioner 608 can be removed through an opening on a front side of the print engine 602 as illustrated in FIG. 6. For example, the conditioner 608 can be pulled out of the front of the print engine 602.

In some examples, the conditioner 608 can increase evaporation of printing fluid deposited on the partially dried inkjet media. In some examples, the increased evaporation of the printing fluid can increase moisture, steam, and/or vapor at an output of the conditioner 608 or within the acceleration zone 614. In some examples, the increased moisture, steam, and/or vapor can result in condensation within the print engine 602 and can damage the partially dried inkjet media and/or components within the print engine 602. In some examples, a vapor manager can be coupled to an output of the conditioner 608. For example, a vapor manager can be coupled between the conditioner 608 and the acceleration zone 614. In some examples, the vapor manager can include an exhaust fan to remove moisture, steam, and/or vapor from the output of the conditioner 608.

As described herein, the partially dried inkjet media can provide difficulties when stacking, aligning, and/or finishing. By including a conditioner 608 within the print engine 602, the partially dried inkjet media can be dried at a relatively faster rate without increasing a foot print of the system 600. In addition, including the conditioner 608 within the print engine 602 can allow standard devices (e.g., paper handling accessories, etc.) to be coupled to an output 616 of the system 600.

Figure 7:
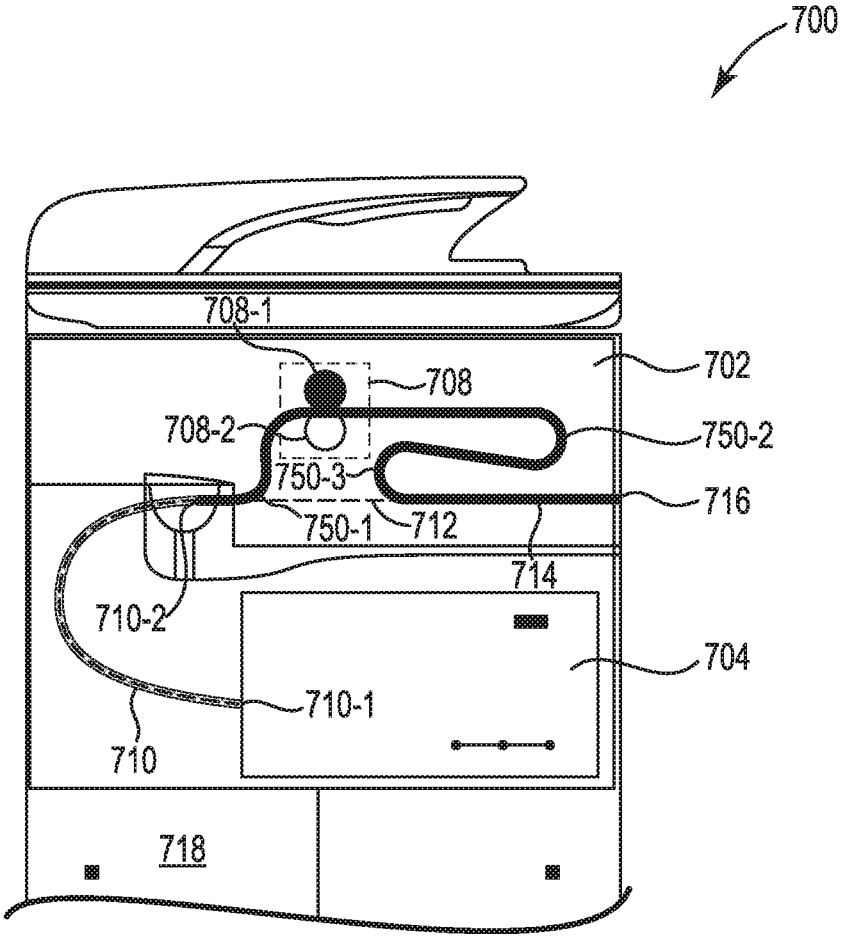
FIG. 7 illustrates an example system for a partially dried inkjet media conditioner consistent with the present disclosure.

FIG. 7 illustrates an example system 700 for a partially dried inkjet media conditioner consistent with the present disclosure. In some examples, the system 700 can include a number of features that are the same or similar as system 100 as referenced in FIG. 1, system 200 as referenced in FIG. 2, system 300 as referenced in FIG. 3, system 400 as referenced in FIG. 4, system 500 as referenced in FIG. 5, and/or system 600 as referenced in FIG. 6. For example, the system 700 can include a print engine 702 that encases a print zone 704, a dryer zone 710 with an input 710-1 coupled to the print zone 704 and an output 710-2 coupled to a conditioner 708.

As described herein, the conditioner 708 can include a heated pressure roller that includes a pressure roller 708-1 to receive a first side of partially dried inkjet media and a heated roller 708-2 to receive a second side of partially dried inkjet media. In some examples, the heated pressure roller of the conditioner 708 can be coupled to an output 710-2 of the dryer zone 710 by a media path 750-1. In these examples, the partially dried inkjet media is able to pass through the entire dryer zone 710.

In some examples, the media path 750-1 can direct the partially dried inkjet media in an upward vertical direction and in a horizontal direction prior to providing the partially dried inkjet media to the conditioner 708. In these examples, the output 710-2 of the dryer zone 710 can be in line with an output 716 of the print engine 702. In these examples, the conditioner 708 can be positioned above the output 710-2 of the dryer zone 710 and/or an output 716 of the print engine 702. In some examples, the output of the conditioner 708 can be coupled to an acceleration zone 714 by media paths 750-2, 750-3. In some examples, the media path 750-2 can vertically lower the partially dried inkjet media and direct the partially dried inkjet media away from the output 716 of the print engine 702 prior to providing the partially dried inkjet media to media path 750-3. In some examples, media path 750-3 can vertically lower and provide the partially dried inkjet media to an input of the acceleration zone 714. In some examples, the media paths 750-2, 750-3 can increase a length of the acceleration zone 714.

In some examples, the system 700 can include a duplexer zone 712. In some examples, the duplexer zone 712 can be utilized for duplexing relatively large print media (e.g., longer media such as Legal, A3, B size, etc.). In some examples, the duplexer zone 712 can be utilized to bypass the conditioner 708 until the relatively large print media has been returned to the print zone 704 to deposit printing fluid on a second side of the relatively large print media. In some examples, the duplexer zone 712 can be positioned inline with the dryer zone 710 and/or below the conditioner 708. In some examples, the duplexer zone 712 can be coupled to an output 710-2 of the dryer zone 710.

In some examples, the conditioner 708 can be positioned above the print zone 704 and the duplexer zone 712. In some examples, the conditioner 708 can include a heated pressure roller that is aligned in a vertical orientation. As used herein, a heated pressure roller in a vertical orientation includes a pressure roller 708-1 that is positioned above a heated roller 708-2. In some examples, the vertical orientation includes a center of a pressure roller 708-1 aligned vertically above a center of a heated roller 708-2. In some examples, the conditioner 708 can be removed through an opening on a front side of the print engine 702 as illustrated in FIG. 7. For example, the conditioner 708 can be pulled out of the front of the print engine 702.

In some examples, the conditioner 708 can increase evaporation of printing fluid deposited on the partially dried inkjet media. In some examples, the increased evaporation of the printing fluid can increase moisture, steam, and/or vapor at an output of the conditioner 708 or within the acceleration zone 714. In some examples, the increased moisture, steam, and/or vapor can result in condensation within the print engine 702 and can damage the partially dried inkjet media and/or components within the print engine 702. In some examples, a vapor manager can be coupled to an output of the conditioner 708. For example, a vapor manager can be coupled between the conditioner 708 and the acceleration zone 714. In some examples, the vapor manager can include an exhaust fan to remove moisture, steam, and/or vapor from the output of the conditioner 708.

As described herein, the partially dried inkjet media can provide difficulties when stacking, aligning, and/or finishing. By including a conditioner 708 within the print engine 702, the partially dried inkjet media can be dried at a relatively faster rate without increasing a foot print of the system 700. In addition, including the conditioner 708 within the print engine 702 can allow standard devices (e.g., paper handling accessories, etc.) to be coupled to an output 716 of the system 700.

Figure 8:
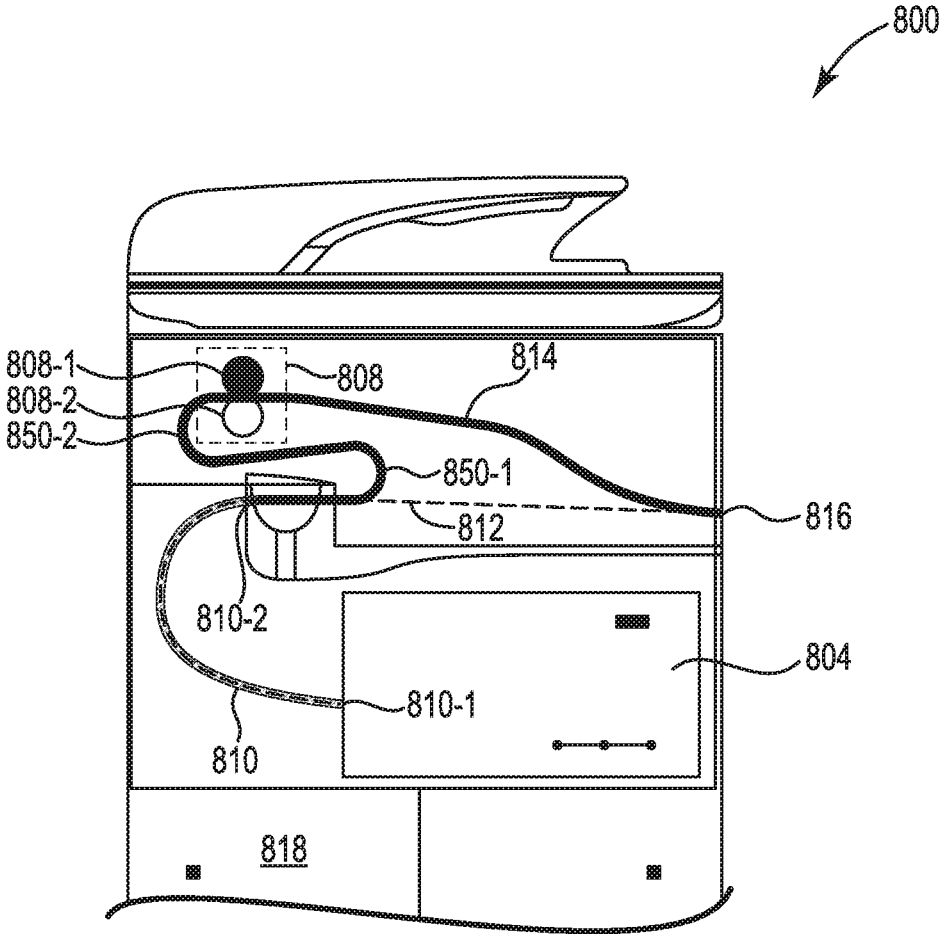
FIG. 8 illustrates an example system for a partially dried inkjet media conditioner consistent with the present disclosure.

FIG. 8 illustrates an example system for a partially dried inkjet media conditioner consistent with the present disclosure. In some examples, the system 800 can include a number of features that are the same or similar as system 100 as referenced in FIG. 1, system 200 as referenced in FIG. 2, system 300 as referenced in FIG. 3, system 400 as referenced in FIG. 4, system 500 as referenced in FIG. 5, 600 as referenced in FIG. 6 and/or system 700 as referenced in FIG. 7. For example, the system 800 can include a print engine 802 that encases a print zone 804, a dryer zone 810 with an input 810-1 coupled to the print zone 804 and an output 810-2 coupled to a conditioner 808.

As described herein, the conditioner 808 can include a heated pressure roller that includes a pressure roller 808-1 to receive a first side of partially dried inkjet media and a heated roller 808-2 to receive a second side of partially dried inkjet media. In some examples, the heated pressure roller of the conditioner 808 can be coupled to an output 810-2 of the dryer zone 810 by media paths 850-1, 850-2. In these examples, the partially dried inkjet media is able to pass through the entire dryer zone 810. In these examples, the conditioner 808 can be positioned in an upper left corner of the print engine 802 as illustrated in FIG. 8. In some examples, utilizing the media paths 850-1, 850-2 can increase a length of an acceleration path 814.

In some examples, the media path 850-1 can direct the partially dried inkjet media in an upward vertical direction and in a horizontal direction away from an output 816 of the print engine 802 prior to providing the partially dried inkjet media to the conditioner 808. In these examples, the output 810-2 of the dryer zone 810 can be in line with an output 816 of the print engine 802. In these examples, the conditioner 808 can be positioned above the output 810-2 of the dryer zone 810 and/or an output 816 of the print engine 802. In some examples, the conditioner can be positioned directly above the dryer zone 810 and/or in an opposite corner of the print engine than the print zone 804. In some examples, the output of the conditioner 808 can be coupled to an acceleration zone 814.

In some examples, the system 800 can include a duplexer zone 812. In some examples, the duplexer zone 812 can be utilized for duplexing relatively large print media (e.g., longer media such as Legal, A3, B size, etc.). In some examples, the duplexer zone 812 can be utilized to bypass the conditioner 808 until the relatively large print media has been returned to the print zone 804 to deposit printing fluid on a second side of the relatively large print media. In some examples, the duplexer zone 812 can be positioned inline with the dryer zone 810 and/or below the conditioner 808. In some examples, the system 800 can utilize media paths 850-1, 850-2 as a duplexer zone. In some examples, the duplexer zone 812 can be coupled to an output 810-2 of the dryer zone 810.

In some examples, the conditioner 808 can be positioned above the print zone 804 and the dryer zone 810. In some examples, the conditioner 808 can include a heated pressure roller that is aligned in a vertical orientation. As used herein, a heated pressure roller in a vertical orientation includes a pressure roller 808-1 that is positioned above a heated roller 808-2. In some examples, the vertical orientation includes a center of a pressure roller 808-1 aligned vertically above a center of a heated roller 808-2. In some examples, the conditioner 808 can include an enclosure that can be removed from an opening on a left side of the print engine 802 as illustrated in FIG. 8. In some examples, the conditioner 808 can be removed through an opening on a front side of the print engine 802 as illustrated in FIG. 8.

In some examples, the conditioner 808 can increase evaporation of printing fluid deposited on the partially dried inkjet media. In some examples, the increased evaporation of the printing fluid can increase moisture, steam, and/or vapor at an output of the conditioner 808 or within the acceleration zone 814. In some examples, the increased moisture, steam, and/or vapor can result in condensation within the print engine 802 and can damage the partially dried inkjet media and/or components within the print engine 802. In some examples, a vapor manager can be coupled to an output of the conditioner 808. For example, a vapor manager can be coupled between the conditioner 808 and the acceleration zone 814. In some examples, the vapor manager can include an exhaust fan to remove moisture, steam, and/or vapor from the output of the conditioner 808.

As described herein, the partially dried inkjet media can provide difficulties when stacking, aligning, and/or finishing. By including a conditioner 808 within the print engine 802, the partially dried inkjet media can be dried at a relatively faster rate without increasing a foot print of the system 800. In addition, including the conditioner 808 within the print engine 802 can allow standard devices (e.g., paper handling accessories, etc.) to be coupled to an output 816 of the system 800.

Figure 9:
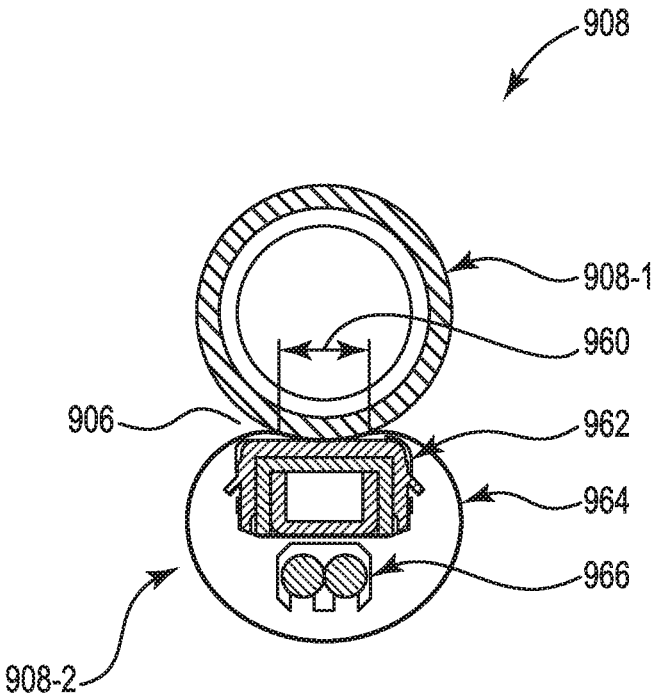
FIG. 9 illustrates an example system for a heated pressure roller consistent with the present disclosure.

FIG. 9 illustrates an example system for a heated pressure roller consistent with the present disclosure. In some examples, the system 908 can be utilized as a conditioner for partially dried inkjet media 906. In some examples, the system 908 can apply pressure on a first side of the partially dried inkjet media 906 and apply heat on a second side of the partially dried inkjet media 906. In some examples, the system 908 can increase drying and/or evaporation of printing fluid applied to the partially dried inkjet media 906.

In some examples, the system 908 can receive partially dried inkjet media 906 at an input of the system 908 (e.g., illustrated as left side as referenced in FIG. 9). In some examples, the system 908 can include a pressure roller 908-1 to apply pressure on a first side of the partially dried inkjet media 906 (e.g., illustrated as top side as referenced in FIG. 9). In some examples, the pressure roller 908-1 can include a contact zone 960. The contact zone 960 can be an area on the pressure roller 908-1 that interacts with the first side of the partially dried inkjet media 906. In some examples, the contact zone 960 can correspond to a pressure platen 962 positioned within a heated roller 908-2.

In some examples, the heated roller 908-2 can apply heat to a second side of the partially dried inkjet media 906 (e.g., illustrated as bottom side as referenced in FIG. 9). In some examples, the heated roller 908-2 can include a heat source 966 to generate heat. The heat source 966 can include a number of different heat sources. For example, the heat source 966 can include a resistive element, an inductive coil, and/or a halogen heat source. In some examples, the heat source 966 can generate heat that is transferred to a heat transfer belt 964. In some examples, the heat transfer belt 964 can rotate around the heated roller 908-2 and contact the second side of the partially dried inkjet media 906 within the pressure platen 962.

The above specification, examples and data provide a description of the method and applications, and use of the system and method of the present disclosure. Since many examples can be made without departing from the spirit and scope of the system and method of the present disclosure, this specification merely sets forth some of the many possible example configurations and implementations.

What is claimed:

1. A partially dried inkjet media conditioner, comprising:

a print engine that encases a print zone within a housing; and a media path coupled to a position of a dryer zone between an input and an output of the dryer zone to provide partially dried inkjet media from the dryer zone to a conditioner within the print engine, wherein the conditioner comprises a heated pressure roller and wherein an output of the conditioner is separate from the output of the dryer zone.

2. The conditioner of claim 1, wherein the heated pressure roller applies pressure to a first side of the partially dried inkjet media and heat to a second side of the partially dried inkjet media.

3. The conditioner of claim 1, wherein the heated pressure roller comprises a first roller that includes a contact zone that applies pressure to a first side of the partially dried inkjet media.

4. The conditioner of claim 3, wherein the heated pressure roller comprises a second roller that includes a heat source and a heat transfer belt to apply heat to a second side of the partially dried inkjet media.

5. The conditioner of claim 1, wherein the heated pressure roller increases evaporation of printing fluid applied to the partially dried inkjet media by the print zone.

6. A system for a partially dried inkjet media conditioner, comprising:

a housing;

a print engine disposed in the housing, wherein the print engine encases a print zone;

a first media path to provide partially dried inkjet media from the print zone to a dryer zone within the print engine; and a second media path coupled to a position of the dryer zone between an input and an output of the dryer zone to provide the partially dried inkjet media from the dryer zone to a conditioner within the print engine, wherein the conditioner comprises a heated pressure roller, the output of the dryer zone is coupled to a duplexer zone, and wherein an output of the conditioner is separate from the output of the dryer zone.

7. The system of claim 6, wherein the heated pressure roller is positioned above the print zone within the print engine.

8. The system of claim 6, wherein the second media path is coupled to an output of the dryer zone.

9. The system of claim 6, wherein the heated pressure roller comprises a vertical orientation with a pressure roller positioned to receive a first side of the partially dried inkjet media and a heated roller positioned to receive a second side of the partially dried inkjet media.

10. The system of claim 6, wherein the heated pressure roller is positioned above the dryer zone.

11. A system for a partially dried inkjet media conditioner, comprising:

an inkjet print engine that encases an inkjet print zone;

a first media path to provide partially dried inkjet media from the inkjet print zone to a dryer zone within the inkjet print engine;

a second media path coupled to a position of the dryer zone between an input and an output of the dryer zone to provide the partially dried inkjet media from the dryer zone to a conditioner positioned above the print zone and the dryer zone within the print engine, wherein the conditioner comprises a heated pressure roller, the output of the dryer zone is coupled to a duplexer zone to return the partially dried inkjet media to the print zone, and wherein an output of the conditioner is separate from the output of the dryer zone; and a third media path to provide the partially dried inkjet media from the conditioner to an output zone.

12. The system of claim 11, wherein the output zone is positioned below the conditioner.

13. The system of claim 11, wherein the heated pressure roller comprises a horizontal orientation with a pressure roller positioned to receive a first side of the partially dried inkjet media and a heated roller positioned to receive a second side of the partially dried inkjet media.

14. The system of claim 11, wherein the conditioner is removable from the inkjet print engine.

* * * * *